US009719515B2

(12) United States Patent
Pohler

(10) Patent No.: US 9,719,515 B2
(45) Date of Patent: Aug. 1, 2017

(54) LIQUID PUMP

(71) Applicant: Liberty Pumps Inc., Bergen, NY (US)

(72) Inventor: Donald M. Pohler, North Chili, NY (US)

(73) Assignee: Liberty Pumps, Inc., Bergen, NY (US)

( * ) Notice: Subject to any disclaimer, the term of this patent is extended or adjusted under 35 U.S.C. 154(b) by 847 days.

(21) Appl. No.: 13/739,041

(22) Filed: Jan. 11, 2013

(65) Prior Publication Data

US 2014/0199165 A1 Jul. 17, 2014

(51) Int. Cl.

| | |
|---|---|
| ***F04D 1/00*** | (2006.01) |
| ***F04D 7/04*** | (2006.01) |
| ***F04D 29/16*** | (2006.01) |
| ***F04D 29/42*** | (2006.01) |

(52) U.S. Cl.
CPC ..... *F04D 1/00* (2013.01); *F04D 7/045* (2013.01); *F04D 29/167* (2013.01); *F04D 29/426* (2013.01)

(58) Field of Classification Search
CPC . F04D 29/426; F04D 7/00; F04D 7/02; F04D 7/045; F04D 1/04
See application file for complete search history.

(56) References Cited

U.S. PATENT DOCUMENTS 3,155,046 A * 11/1964 Vaughan ..... F04D 29/2288 241/185.6
4,454,993 A * 6/1984 Shibata et al. ..... 241/46.017
5,122,032 A * 6/1992 Shields et al. ..... 415/214.1
5,460,482 A * 10/1995 Dorsch ..... F04D 7/045 415/121.1
7,159,806 B1 1/2007 Ritsema
7,237,736 B1 * 7/2007 Martin ..... 241/46.06
7,537,439 B2 5/2009 Pohler
2012/0207590 A1 8/2012 Pohler

OTHER PUBLICATIONS

Pentair Myers Model MRG20 Grinder Pump Installation and Service Manual, product document dated Nov. 8, 2012. EFS file name 20151022_13-739041_IDS_NPL_Cite1.pdf.
ABS "S" Series 2—4hp Piranha Grinder Pump product literature, product document pdf Created: Jul. 13, 2000. EFS file 20151022_13-739041_IDS_NPL_Cite2.pdf.
Jung Pumpen G2DT/G2D-Series product literature, product document pdf Created: Dec. 7, 2010. EFS file name 20151022_13-739041_IDS_NPL_Cite3.pdf.

* cited by examiner

*Primary Examiner* — Dwayne J White
*Assistant Examiner* — Su Htay
(74) *Attorney, Agent, or Firm* — John M. Hammond; Patent Innovations LLC

(57) ABSTRACT

A pump for pumping liquids containing entrained solids. The pump includes a volute surrounding an impeller comprising vanes that are self-cleaning. The outer surfaces of the vanes are coplanar and define a first plane and have a leading edge. The volute includes a planar mating surface defining a second plane parallel to the first plane of the rotary impeller. The planar mating surface is proximate to the outer surfaces of the vanes and includes a plurality of channels extending radially from the inner perimeter to the outer perimeter thereof. Each channel includes a forward edge in the direction of impeller rotation. The channels are oriented such that when the impeller is rotated within the volute, for any vane, the leading edge of the vane traverses each channel progressively from the inner end of the channel to the outer end of the channel.

13 Claims, 11 Drawing Sheets

LIQUID PUMP

BACKGROUND

Technical Field

Pumps for the transfer of liquids; more particularly, centrifugal pumps, and centrifugal grinding pumps.

Description of Related Art

A pump is a device used to transport liquid from a lower to a higher elevation, or from a vessel of lower pressure to a vessel of higher pressure, or to a state of low velocity to a state of high velocity. Generally, in transporting a liquid, a pump adds energy to the liquid. Typically, an electric motor or other suitable motor is used to spin an impeller or other liquid driver inside a volute casing, transferring energy to the liquid. In many instances, a pump is submerged in a pool and its discharge is connected to a pipe that is used to convey the liquid to a higher elevation. Although pumps have been known for millennia, and advances in the design and manufacturing of pumps have continued right up to the present, there remain opportunities for improvement in many aspects of pump design, such as efficiency, reliability, and manufacturing cost.

This applies to centrifugal pumps, and to grinder pumps. A grinder pump is a pump that reduces the size of solid objects suspended in the liquid. In a typical grinder pump, a cutting or grinding device is incorporated into the suction opening of the pump, which chops or reduces the size of solid objects as the pump moves the liquid. The design of the cutting/grinding device varies by manufacturer, but in essentially all centrifugal grinder pumps, the slurry from the cutting/grinding device is drawn from the cutting apparatus to the eye of an impeller. Under normal operation, the slurry passes through the impeller vanes and volute casing without problems; however problems often do occur.

Solid debris from the slurry often accumulates between the vanes of the impeller and the stationary volute casing, causing undesired friction and load on the pump motor, which reduces the efficiency of the pump. In the worst cases, the debris may block an entire vane passageway or jam the impeller. In one attempt to address this problem, long "record" (spiral) grooves are formed in the volute base surface that is proximate to the impeller vanes in an attempt to cause accumulated material to be shed from the impeller, or prevent accumulation of material on the impeller. These record grooves are of limited effectiveness, particularly with certain types of solid materials in the slurry. What is needed to address this problem is a more reliable and effective means of shedding accumulated solid material from a pump impeller and/or preventing solid material from accumulating on the impeller, which would increase the reliability and efficiency of a grinder pump.

A critical component in any liquid pump is the seal that prevents liquid from leaking from the volute along the rotating shaft into the housing that contains the pump motor. Typically a mechanical face seal is used that is comprised of two ground surfaces riding on each other with a very thin layer of liquid between them as a lubricant. Foreign material suspended in the liquid or long fibrous strands can either wrap around the seal, thereby forcing it open or eroding one or both of the ground surfaces. In either case, the seal is damaged. This is particularly the case in a grinder pump application, where the seal is exposed to a liquid slurry containing suspended solids. There remains a need for extending the life of a seal in a grinder pump, which would increase the reliability and reduce the maintenance cost of the pump while avoiding the additional cost of downtime of the pumping process.

In a related aspect, a pump may be damaged if it is run dry, even if for only a short period of time. In particular, the seal may be damaged by running the pump without having adequate liquid in the volute to maintain the seal in a wet condition. There remains a need for a pump that can be run in a dry state for a more prolonged period of time, thereby extending seal life.

The cost of energy is becoming an increasingly important consideration when selecting a pump for a given application. There remains a need for improving the efficiency of pumps, including grinder pumps, so that a given pumping output may be attained with less energy consumption by the pump.

Manufacturing cost and manufacturing precision are also important considerations in pump selection. Greater manufacturing precision results in greater pump reliability, and lower manufacturing cost results in lower purchase cost for the end user. The basic structure of a centrifugal grinder pump has remained quite complex, in that the pump includes a pump motor housing, a multi-piece pump volute, and a grinding device, which are expensive to manufacture individually, and to assemble in a reliable manner. Hence there remains a need for a pump having fewer components that are lower in cost to manufacture and assemble, and which can be assembled with greater precision, thereby resulting in greater pump reliability.

SUMMARY

In accordance with the present disclosure, in a pump, the problem of shedding accumulated solid material from a pump impeller and/or preventing solid material from accumulating on the impeller is solved by a pump that comprises a rotary impeller and a volute having particular features. The impeller is comprised of a flange surrounding a central hub. The flange includes a plurality of vanes, each vane extending radially from the hub and having an inner vane end, an outer vane end, and an outer surface. The outer surfaces of the vanes are coplanar and define a first plane and have a leading edge. The volute surrounds the impeller and is comprised of a planar mating surface defining a second plane parallel to the first plane of the rotary impeller. The planar mating surface is proximate to the outer surfaces of the vanes and has an inner perimeter forming an inlet opening of the volute and an outer perimeter. The planar mating surface is further comprised of a plurality of channels extending radially from an inner channel end at the inner perimeter to an outer channel end at the outer perimeter. Each of the channels includes a forward edge in the direction of impeller rotation. The channels are oriented such that when the impeller is rotated within the volute, for any vane, the leading edge of the vane traverses each channel progressively from the inner end of the channel to the outer end of the channel.

In certain embodiments, the vanes and the channels may be arcuate in shape with the leading edges of the vanes being convex edges, and the forward edges of the channels also being convex edges. In such a configuration, the angle of intersection of any vane with any channel decreases during progression of the intersection from the inner channel end to the outer channel end. During rotation of the impeller, the angle of intersection of any vane with any channel may transition from an obtuse angle to an acute angle.

In certain embodiments, the inner vane ends may be contiguous with the central hub. The outer vane ends may be contiguous with the outer perimeter of the flange. The outer ends of the vanes may extend radially beyond the outer perimeter of the planar mating surface of the volute. The number of vanes may vary between 1 and 11, and the number of channels may vary between 1 and 9. The number of vanes may be at least equal to the number of channels.

In certain embodiments, the distance between the outer surfaces of the impeller vanes and the planar mating surface of the volute may be between 0.005 inches and 0.06 inches. Having a minimal vane-to-mating surface is advantageous with respect to pump efficiency, and in some embodiments, the clearance may be lesser. In some embodiments, the width of the outer surfaces of the vanes may be between 0.125 inches and 0.5 inches, and the width of the channels may be between 0.08 and 0.12 inches.

In certain embodiments, the planar mating surface may be further comprised of a plurality of stub channels, each of the stub channels extending from the inner perimeter of the planar mating surface to between one quarter and one half of the distance to the outer perimeter of the planar mating surface.

In another aspect of the Applicants' liquid pump, the problem of reducing pump manufacturing and assembly cost while enabling greater precision of pump assembly is solved by providing a unitary pump volute formed as a single piece and comprising certain features. The volute of the pump is comprised of a volute chamber comprised of an upper wall, a side wall and a lower wall. A first annular structure extends upwardly from the upper wall of the volute chamber and is comprised of a cylindrical cavity having a first annular side wall and a bottom wall. A cylindrical passageway extends from the bottom wall of the cylindrical cavity to the volute chamber. The cylindrical passageway may be partially bounded by a second annular side wall which terminates at a planar bottom surface. A second annular structure surrounds the first annular structure, and extends upwardly from the upper wall of the volute chamber. The second annular structure may be comprised of an outer cylindrical wall. A planar flange also surrounds the first annular structure. The inner perimeter of the planar flange may be contiguous with the outer cylindrical wall of the second annular structure. A through opening is provided in the lower wall of the volute chamber to enable the installation of an impeller on a pump motor shaft, and to enable access to the impeller if maintenance of the pump is needed.

The pump is further comprised of a motor housing joined to the pump volute. The motor housing is comprised a lower planar surface contiguous with the planar flange of the pump volute. With regard to the pump volute, the first annular side wall, the cylindrical passageway, and the outer cylindrical wall have collinear central axes defining a common central axis. The bottom wall of the cylindrical cavity, the planar bottom surface, and the planar flange define planes parallel to each other and perpendicular to the central axes. These features enable reducing the pump manufacturing and assembly cost while enabling greater precision of assembly of the pump and greater pump reliability as will be explained subsequently in this disclosure.

In another aspect of the Applicants' liquid pump, the problem of extending the life of a seal in the pump is solved by providing a pump volute, a rotary shaft, and a rotary impeller including certain features. The volute is comprised of a volute chamber having an upper wall including an annular recess surrounding a downward annular structure, and a passageway extending through the downward annular structure. The rotary shaft extends through the passageway into the volute chamber. The rotary impeller is joined to the rotary shaft and is comprised of a flange including an upward annular structure extending into the annular recess of the upper wall of the volute chamber.

The seal is fitted to a lower edge of the downward annular structure and prevents the leakage of fluid from the volute into the motor and/or a housing containing the motor. The location of the seal on the lower edge of the downward annular structure positions it such that it is disposed within the passageway and surrounds a portion of the rotary shaft. The lower portion of the seal extends into an annular cavity that is formed between the rotary shaft and the upward annular structure of the impeller. In that manner, if the pump temporarily runs dry or takes in some air, the seal remains wetted, lubricated, and cooled by at least some liquid, thereby preventing damage to the seal and extending its life. Additionally, the downward annular structure and the annular recess coact to prevent solids in a liquid slurry in the volute from reaching the seal while maintaining the seal in a wet condition. This also prevents damage to the seal and extends its life.

In another of the Applicants' liquid pump configured as a grinder pump, the problem of increasing pump efficiency by reducing energy consumption is solved by a solids cutting assembly that has reduced operating friction and reduced drag in the liquid to be pumped. Thus the pump requires less energy to accomplish the same amount of solids grinding and liquid pumping. The cutting assembly is comprised of a rotatable drive shaft and a rotary cutter joined to the drive shaft and comprised of a frustoconical hub having a circular planar hub base, and a first cutting blade and a second cutting blade.

Each of the cutting blades is comprised of a planar blade base defining a cutting plane and terminating at a cutting edge extending tangentially outwardly from the circular planar hub base. At any radial distance along each cutting blade, the ratio of the width of the cutting blade to the thickness of the cutting blade at that radial distance is at least is at least about two, and preferably at least about three. Additionally, at any radial distance along each cutting blade, the maximum thickness of the cutting blade is located at least 70 percent of the distance across the cutting blade in the direction opposite the direction of rotation.

The pump is further comprised of a cutter plate comprising an outer planar cutter surface parallel to and proximate to the cutting plane of the cutting blades. Rotary motion of the rotary cutter creates a shearing region between the cutting edges of the cutter and the cutter surface.

The first and second cutting blades may be further comprised of a first angled outer surface terminating at the cutting edge. In such a configuration, the first angled outer surface is on the leading side of the blade with respect to the direction of cutter rotation and may form an acute angle with the blade base of less than 45 degrees. The first and second cutting blades may be further comprised of a second angled outer surface terminating at the blade base. In such a configuration, the second angled outer surface is on the trailing side of the blade with respect to the direction of cutter rotation and may form an approximately perpendicular or obtuse angle with the blade base.

BRIEF DESCRIPTION OF THE DRAWINGS

The present disclosure will be provided with reference to the following drawings, in which like numerals refer to like elements, and in which.

Figure 1:
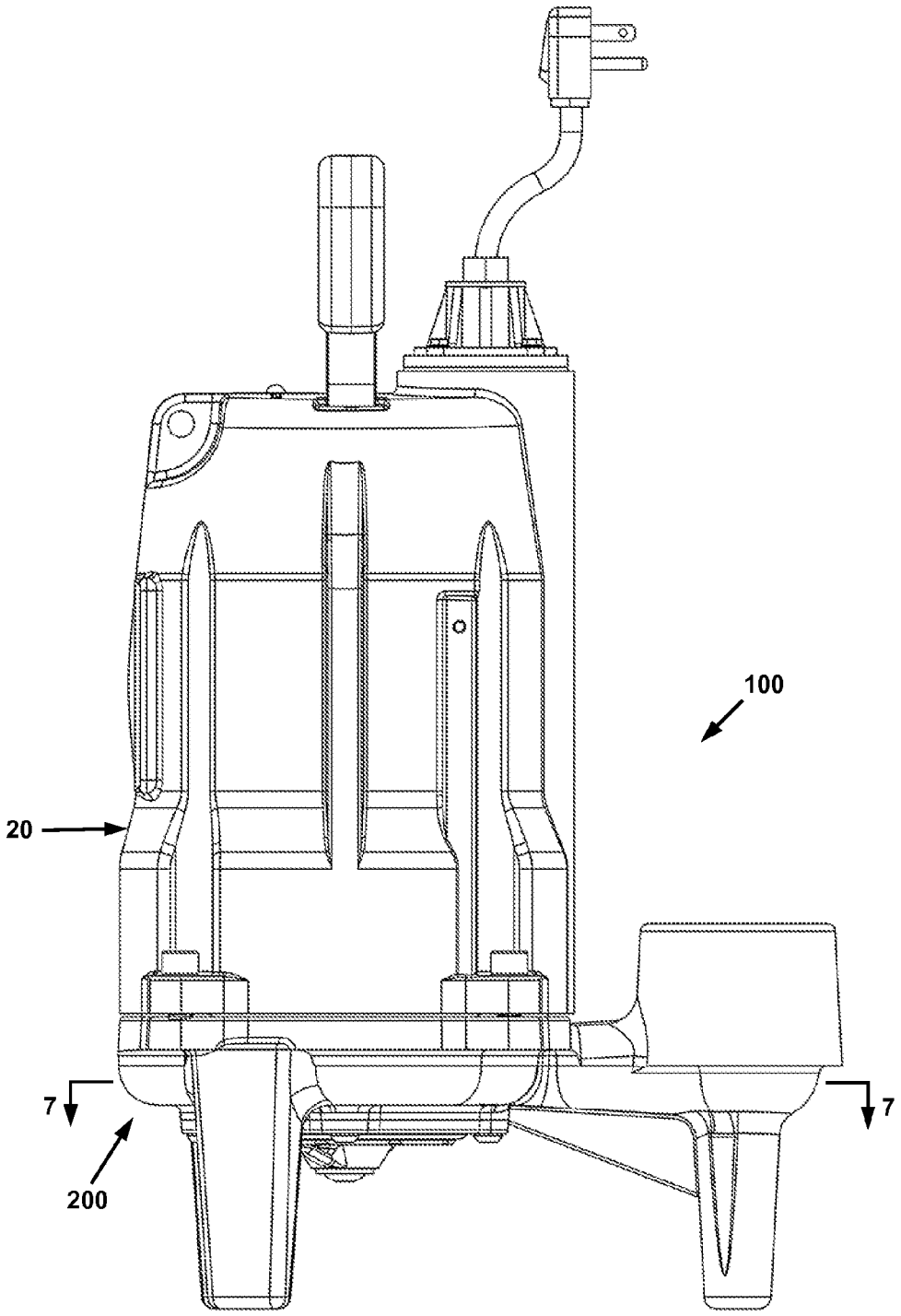
FIG. 1 is a side elevation view of one embodiment of the Applicants' pumps provided as a grinder pump.

The present invention will be described in connection with certain preferred embodiments. However, it is to be understood that there is no intent to limit the invention to the embodiments described. On the contrary, the intent is to cover all alternatives, modifications, and equivalents as may be included within the spirit and scope of the invention as defined by the appended claims.

DETAILED DESCRIPTION

For a general understanding of the present invention, reference is made to the drawings. In the drawings, like reference numerals have been used throughout to designate identical elements. In the following disclosure, certain components of the invention may be identified with adjectives such as "top," "upper," "bottom," "lower," "left," "right," etc. These adjectives are provided in the context of use of the Applicants' pumps in a position in which the axis of pump impeller rotation is vertical, and/or in the context of the orientation of the drawings, which is arbitrary. The description is not to be construed as limiting the Applicants' pumps to use in a particular spatial orientation. The instant pumps may be used in orientations other than those shown and described herein.

Additionally, certain embodiments of the Applicants pumps are described with the drawings showing a "grinder pump," i.e., a pump that is used to macerate solids entrained in the liquid to be pumped. It is to be understood that these embodiments are not limited to being only applicable to grinder pumps, but instead are applicable to any pumps comprised of a rotary impeller surrounded by a volute.

Referring first to FIGS. 3-8, in one aspect of the Applicants' pump, the problem of shedding accumulated solid material from a pump impeller and/or preventing solid material from accumulating on the impeller is solved by a pump 10 that comprises a rotary impeller 100 and a volute 200 having particular features. The impeller is comprised of a flange 110 surrounding a central hub 120. The flange 110 may include a plurality of vanes 130. Each vane 130 extends radially from the hub 120 and has a proximal end 132, a distal end 134, and an outer surface 136. The outer surfaces 136 of the vanes 130 are coplanar and define a first plane. Each of the vanes 130 has a leading edge 138, which bounds the vane outer surface 136 in the direction of impeller rotation indicated by arrows 139.

The volute 200 surrounds the impeller 100 and is comprised of a planar mating surface 252 defining a second plane that is parallel to the first plane of the rotary impeller 100. In certain embodiments, the planar mating surface 252 is provided on the inner side 251 of a removable volute bottom cover 250, which is fitted to a circular or cylindrical cover opening 242 in the bottom wall 240 of the volute 200. The planar mating surface 252 is proximate to the outer surfaces 136 of the vanes 130, and has an inner perimeter 254. An inlet opening 256 of the volute is formed between the inner perimeter 254 and the hub 120 of the impeller 100.

The planar mating surface 252 is further comprised of a plurality of channels 260 extending radially from an inner channel end 262 at the inner perimeter 254 to an outer channel end 264 at the outer perimeter 258 of the planar mating surface 252. Each of the channels 260 includes a forward edge 266 in the direction 139 of impeller rotation. The channels 260 are oriented such that when the impeller 100 is rotated within the volute 200, for any vane 130, the leading edge 138 of the vane 130 traverses each channel 260 progressively from the inner end 262 of the channel 260 to the outer end 264 of the channel 260.

Figure 5:
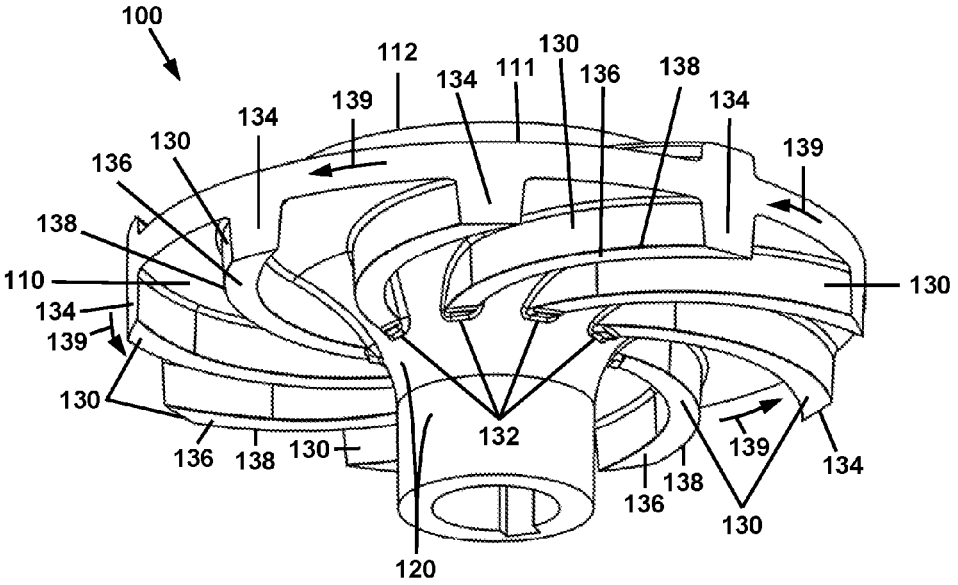
FIG. 5 is a lower perspective view of a pump impeller.
Figure 6:
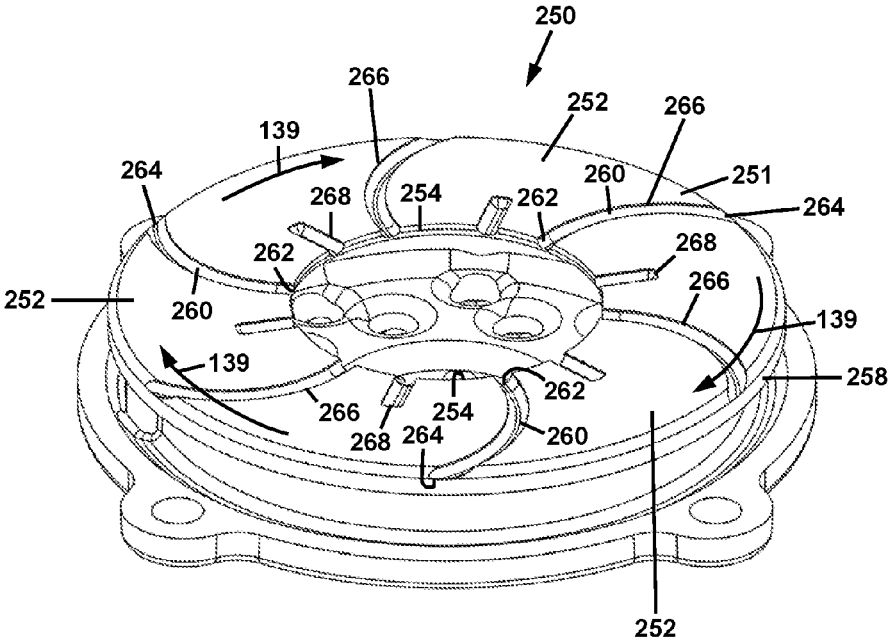
FIG. 6 is a upper perspective view of a plate that forms the lower portion of the volute of the pump.
Figure 7:
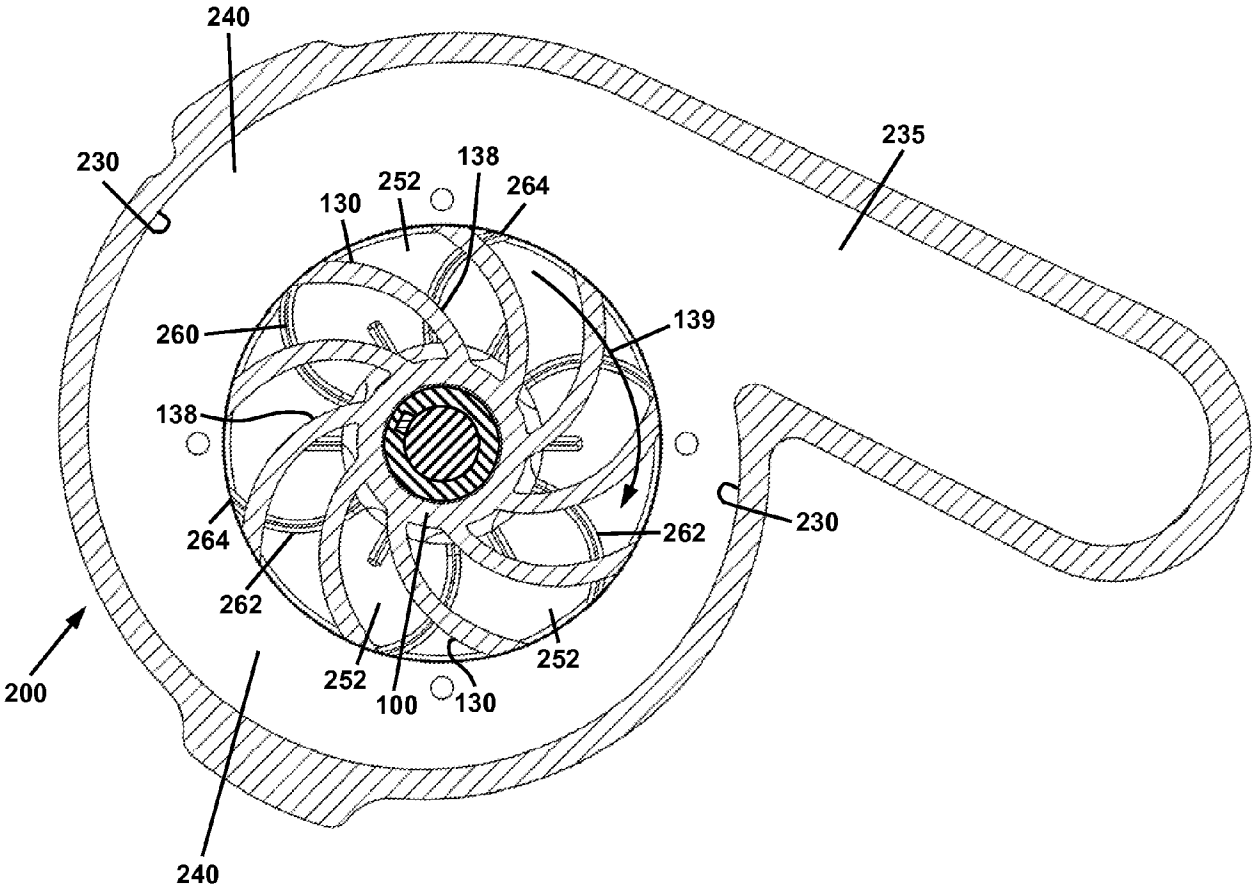
FIG. 7 is a cross sectional view of the pump volute, impeller, and lower volute plate of the pump of FIG. 1, taken along the line 7-7 of FIG. 1.

Referring in particular to FIGS. 5-7, in certain embodiments, the vanes 130 and the channels 260 may be arcuate in shape, with the leading edges 138 of the vanes 130 being convex edges, and the forward edges 266 of the channels 260 also being convex edges. (The forward edges 266 are the edges of the channels 260 that are opposite the direction of rotation of the impeller 100, i.e., the edges toward the leading edges 138 of the vanes 130.) In such a configuration, the angle of intersection of any vane 130 with any channel 260 decreases during progression of the intersection from the inner channel end 262 to the outer channel end 264. During rotation of the impeller 100, the angle of intersection of any vane 130 with any channel 260 may transition from an obtuse angle to an acute angle.

In certain embodiments, the proximal vane ends 132 may be contiguous with the central hub 120. The distal vane ends 134 may be contiguous with the outer perimeter 111 of the flange 110. The distal ends 134 of the vanes 130 may extend radially beyond the outer perimeter 258 of the planar mating surface 252 of the volute 200.

In certain embodiments, the number of vanes 130 may be between 1 and 11, and the number of channels 260 may be between 1 and 9. In other words, the impeller 100 may be a single vane impeller wherein the single vane spirals outwardly around the flange 110, and the planar mating surface 252 may have a single channel that spirals outwardly around it. The number of vanes 130 may be at least equal to the number of channels 260.

In certain embodiments, the distance between the outer surfaces 136 of the impeller vanes 130 and the planar mating surface 252 of the volute 200 may be between 0.005 inches and 0.06 inches. Having a minimal vane-to-mating surface is advantageous with respect to pump efficiency, and in some embodiments, the clearance may be lesser. In general, the pump capacity is reduced by 1% for each additional 0.001 inches (0.025 mm) of impeller clearance.

The Applicants have determined that the width of the outer surfaces 136 of the impeller vanes 130 are affected by the manufacturing method, pumping media, and flow required. The size or outside diameter of the impeller 130 defines the head of the pump but a larger impeller will also flow more and thus require more power to drive. In some instances the flow of the pump may be reduced by narrowing the space between the vanes and thus increasing the size of the outer surfaces 136. The design of the pump impeller 100 is a balance between motor size and desired output. Additionally, in some embodiments, the impeller 100 may have only a single vane which spirals outwardly around the flange 110 of the impeller. In general, across a range of pump applications, the width of the outer surfaces 136 of the impeller vanes 130 may be between 0.125 inches and 0.5 inches.

The Applicants have discovered that a pump 10 comprising an impeller 100 with vanes 130 and a volute 200 comprising a planar mating surface 252 with channels 260 operates in a manner in which solid particles suspended or entrained in the liquid to be pumped do not accumulate between the impeller and the volute. Accordingly, the pump operates more efficiently and uses less energy since a continuous liquid flow field is maintained proximate to the impeller, and drag on the impeller is reduced. Without wishing to be bound to any particular theory, the Applicants believe that the vanes 130 of the impeller 100 coact with the channels 260 in the planar mating surface 252 to continuously cause any solid particles that begin to adhere on or near the outer surfaces 136 of the vanes 130 to be dislodged and ejected out into the radial volume of the volute 200, and on out of the volute 200 with other solids in the liquid being pumped.

The Applicants have further discovered that having channels 260 with excessive width decreases performance of the channels 260 and reduces pump efficiency. Thus the width and depth of the channels 260 should be minimized. In general, a channel width and depth of about 0.10" has been found to achieve the desired effect, although other channel sizes may be suitable depending upon the size and application of the particular pump.

In some embodiments, the channels 260 may be cast into the volute bottom cover 250, and then the planar mating surface 252 may be machined to provide the channels 260 in final form. The Applicants have further discovered that it is preferable that the forward edges 266 are sharp in order to more effectively grab and tear off any material debris that has begun to accumulate on the impeller 100; and that arcuate channels 260 mirrored to that of the impeller (as described previously) are most effective at removing debris, straight channels are also effective, and arcuate channels with curvature matching that of the impeller are least effective.

In certain embodiments, the planar mating surface 252 may be further comprised of a plurality of stub channels 268, each of the stub channels 268 extending from the inner perimeter 254 of the planar mating surface 252 to between one quarter and one half of the distance to the outer perimeter 258 of the planar mating surface 252. The Applicants have discovered that the stub channels 268 are effective at preventing debris accumulation at the eye of the impeller, which is important for maintaining pump efficiency.

Figure 2:
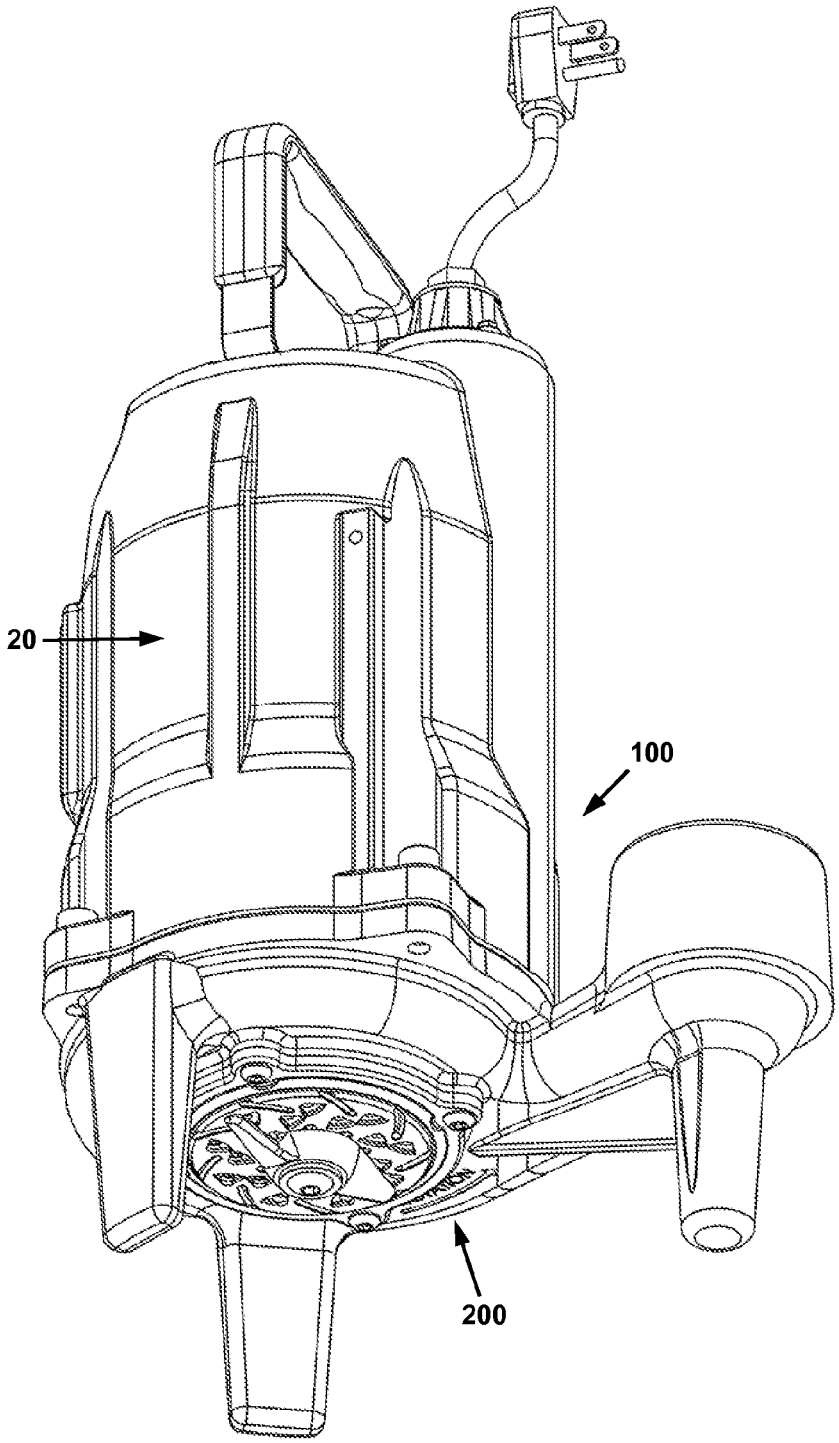
FIG. 2 is a lower perspective view of the pump of FIG. 1, depicting the lower portion of the pump volute, grinder cutter plate, and cutter.
Figure 3:
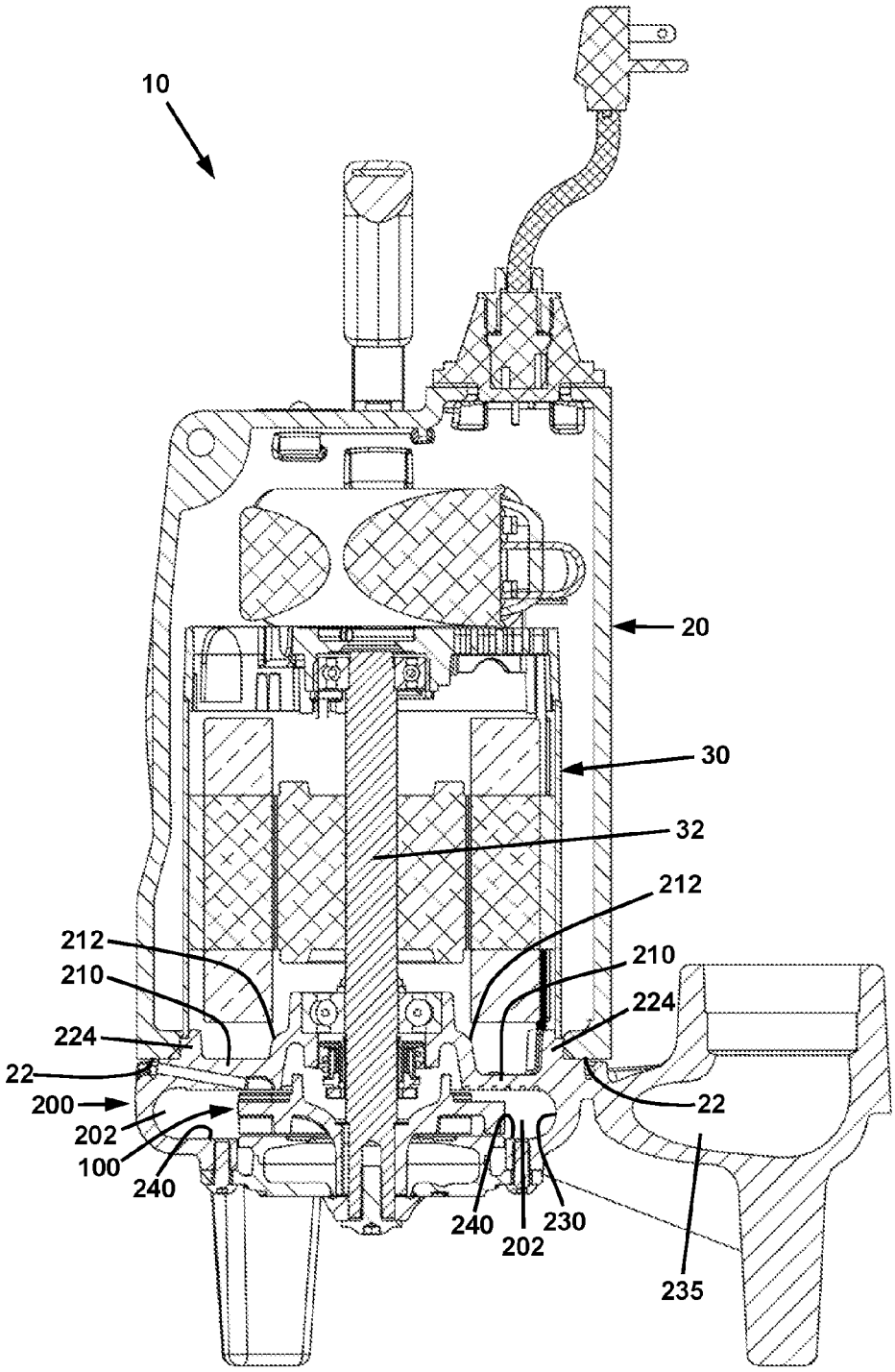
FIG. 3 is a side cross-sectional view of the pump of FIG. 1.
Figure 4:
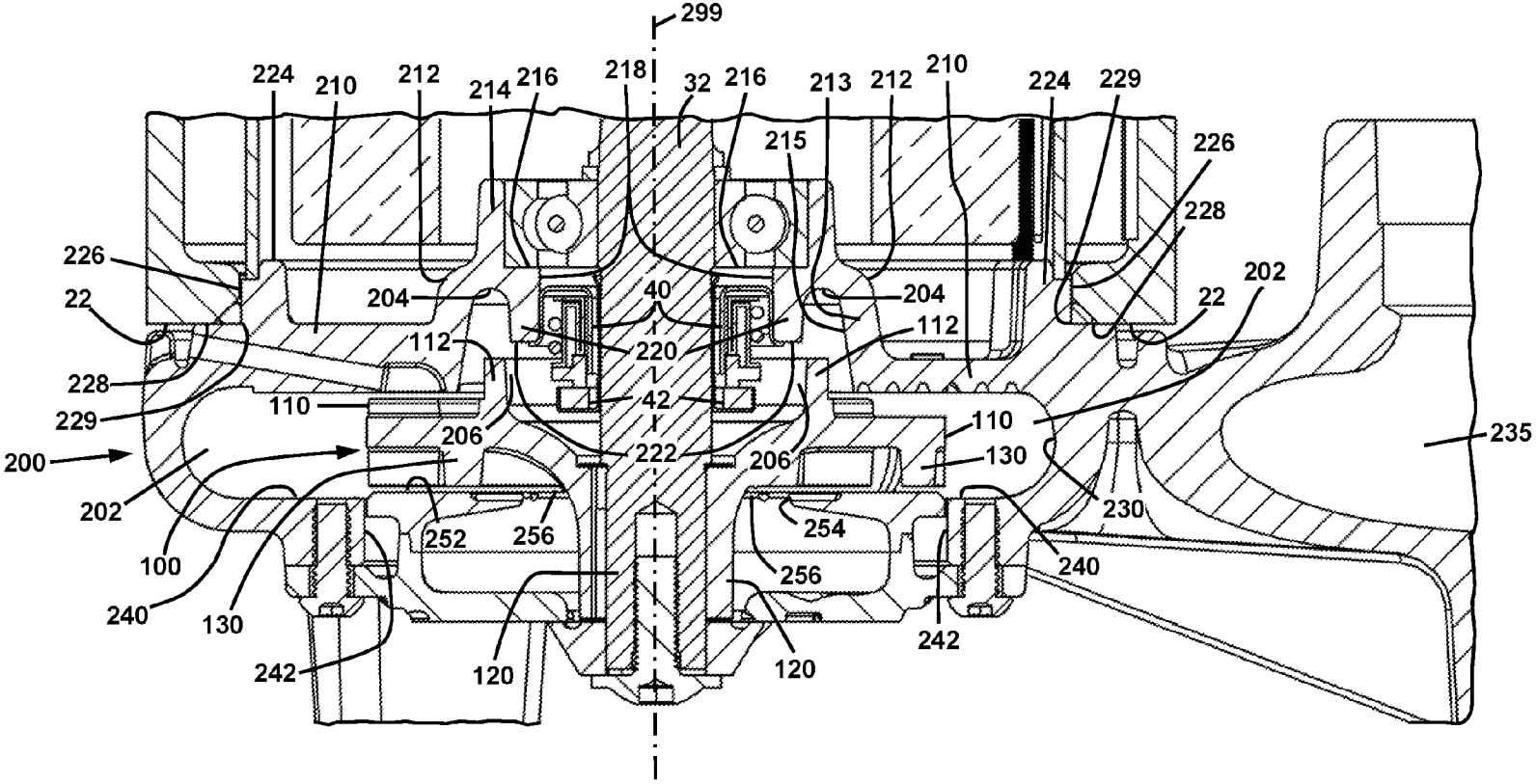
FIG. 4 is a detailed cross-sectional view of the volute, impeller, and cutter of the pump of FIG. 1.
Figure 8:
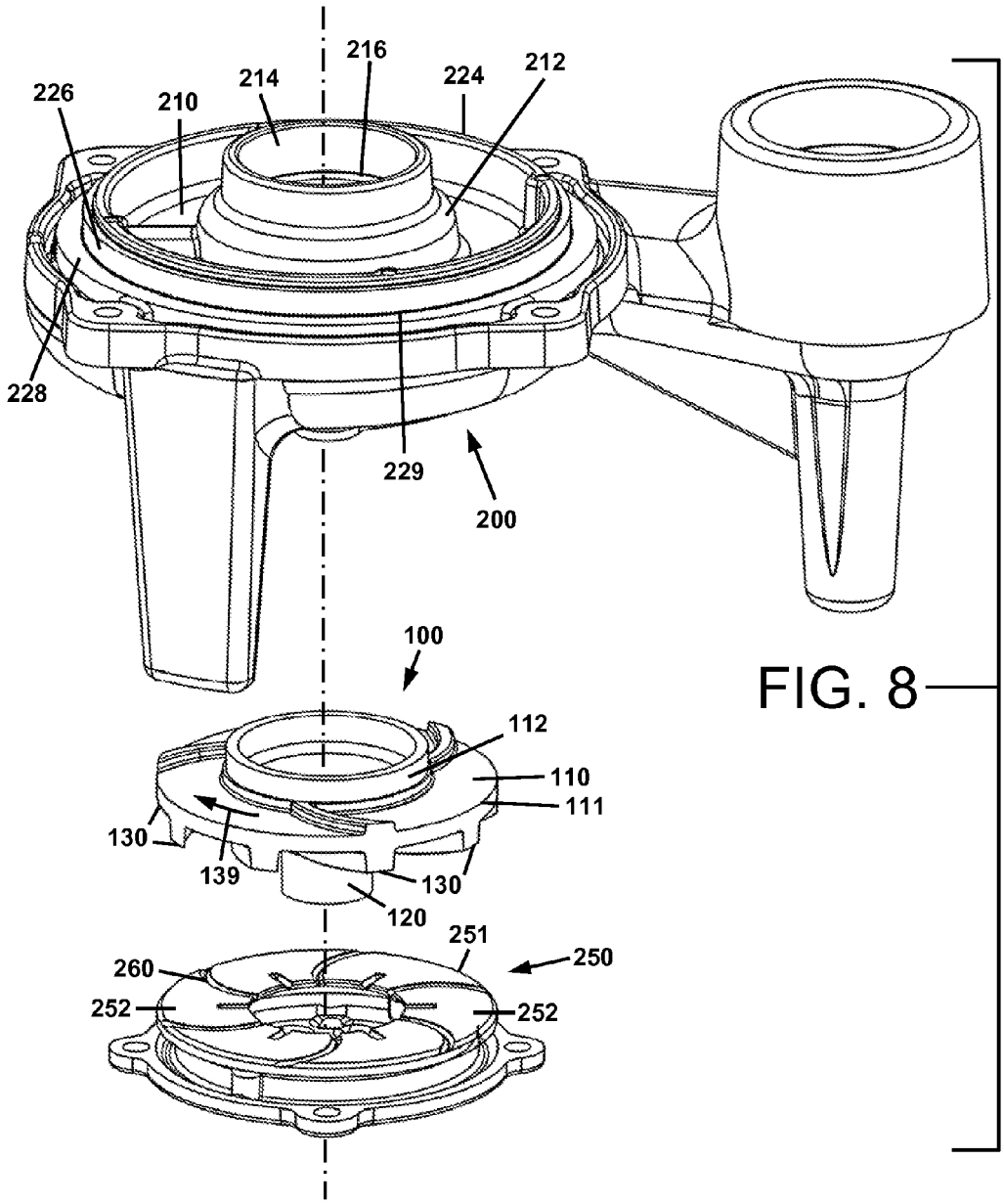
FIG. 8 is an exploded perspective view of a pump volute, impeller, and lower volute plate of certain embodiments of the Applicants' pumps.

Referring now to FIGS. 1-8, in another aspect of the Applicants' liquid pump, the problem of reducing pump manufacturing and assembly cost while enabling greater precision of pump assembly is solved by providing a unitary pump volute 200 formed as a single piece and comprising certain features. Referring in particular to FIGS. 4, 7, and 8, the volute 200 of the pump is comprised of a volute chamber 202 comprising an upper wall 210, a side wall 230, an outlet passageway 235 in communication with the chamber 202, and a lower wall 240. A first annular structure 212 is comprised of a lower portion 213 including a lower side wall 215 and extending upwardly from the upper wall 210 of the volute chamber 202. The first annular structure 212 is further comprised of an upper portion including an upper cylindrical cavity having a first annular side wall 214 and a bottom wall 216.

A cylindrical passageway 218 extends from the bottom wall of the cylindrical cavity to the volute chamber 202. The cylindrical passageway 218 may be partially bounded by a second annular side wall 220 which terminates at a planar bottom surface 222.

A second annular structure 224 surrounds the first annular structure 212, and extends upwardly from the upper wall 210 of the volute chamber 202. The second annular structure 224 may be comprised of an outer cylindrical wall 226. A planar flange 228 also surrounds the first annular structure. The inner perimeter 229 of the planar flange 228 may be contiguous with the outer cylindrical wall 226 of the second annular structure 224.

As described previously, a through opening 242 is provided in the lower wall 240 of the volute chamber 202. This opening 242 enables the installation of an impeller 100 on a pump motor shaft 32, and further enables access to the impeller 100 if maintenance of the pump 10 is needed.

Referring to FIGS. 1-3, the pump 10 is further comprised of a motor housing 20 joined to the pump volute 200. The motor housing 20 is comprised a lower planar surface 22 that is contiguous with the planar flange 228 of the pump volute 200.

With regard to the pump volute 200, the first annular side wall 214, the cylindrical passageway 218, the outer cylindrical wall 226, and the lower through opening 242 have collinear central axes defining a common central axis 299. The bottom wall 216 of the cylindrical cavity, the planar bottom surface 222, and the planar flange 228 define planes parallel to each other and perpendicular to the common central axis 299.

By making the pump volute 200 from a single piece of material, the planar surfaces, cylindrical cavities, and passageways of the volute 200 can be bored and/or milled on a single machine with great precision. Thus the problem of "tolerance stack up" that occurs when fitting together multiple volute pieces made on different machines is avoided. The motor housing, motor shaft bearing (which supports and aligns the motor shaft and stator), seal, and volute bottom cover plate are all located on these surfaces, cavities, and/or passageways. Fabricating the volute from a single piece of material such as cast iron, plastic, or a composite, enables all of these pieces to be properly aligned and squared relative to each other. This results in a reduction of pump manufacturing and assembly cost while enabling greater precision of assembly of the pump and thus greater pump reliability.

Referring again to FIGS. 4 and 8, in another aspect of the Applicants' liquid pump, the problem of extending the life of a seal in the pump is solved by providing pump volute 200, a rotary shaft 32, and a rotary impeller 100 including certain features. The volute 200 is comprised of a volute chamber 202 having an upper wall 210 that includes an annular recess 204 surrounding a downward annular structure 220. A passageway 218 extends through the downward annular structure 220. The rotary shaft 32 of the pump motor 30 (FIG. 3) extends through the passageway 218 into the volute chamber 202. The rotary impeller 100 is joined to the rotary shaft 32 and is comprised of a flange 110 including an upward annular structure 112 that extends into the annular recess 204 of the upper wall 210 of the volute chamber 202.

The pump seal 40 is fitted to a lower edge or surface 222 of the downward annular structure 220 and prevents the leakage of fluid from the volute chamber 202 into the motor 30 and/or a housing 20 containing the motor 30. The location of the seal 40 on the lower edge 222 of the downward annular structure 220 positions the seal 40 such that it is disposed within the passageway 218 and surrounds a portion of the rotary shaft 32. The lower portion 42 of the seal extends into an annular cavity 206 that is formed between the rotary shaft 32 and the upward annular structure 112 of the impeller 100. In that manner, if the pump 10 temporarily runs dry or takes in some air, the seal 40 remains wetted, lubricated, and cooled by at least some liquid, thereby preventing damage to the seal 40 and extending its life. Additionally, from the upper side of the seal 40, during operation of the pump, oil from within the motor housing flows down through the ball bearing and cylindrical passageway 218 down to the shaft seal 40.

Additionally, the downward annular structure 220 and the annular recess 204 coact to greatly reduce the amount of solids in a liquid slurry in the volute chamber 202 that reaches the seal 40, while maintaining the seal 40 in a wet condition. By the configuration of the annular recess 204 of the volute 200, and the upward annular structure 112 of the impeller 100, the seal 40 is remotely located from the main portion of the volute chamber 202, and operates in a relativity low pressure environment. In that manner, the seal 40 is shielded from much of the solid debris in the liquid being pumped. Additionally, the Applicants have found that this configuration prevents any "roping" (i.e. string-like accumulation) of solids on the faces of the seal 40. Thus damage to the seal 40 is avoided, thereby extending seal life and overall pump reliability.

Referring now to FIGS. 2, 9A-9D, and 10A-10D, in another of the Applicants' liquid pump configured as a grinder pump, the problem of increasing pump efficiency by reducing energy consumption is solved by a solids cutting assembly 300 that has reduced drag in the liquid to be pumped. Thus the pump 10 requires less energy to accomplish the same amount of solids grinding and liquid pumping.

Figure 9A:
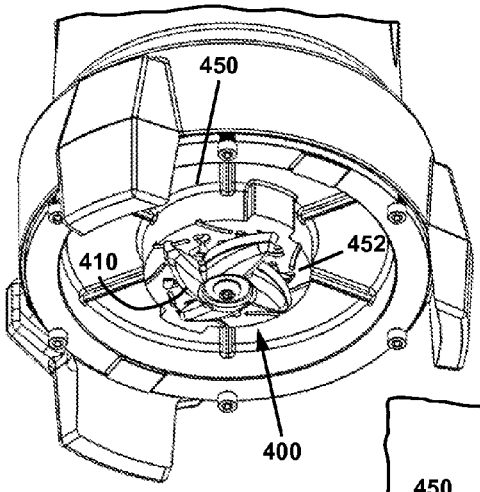
PRIOR ART FIG. 9A
FIGS. 9A-9D are views of a cutter and cutter plate of a prior art grinder pump presented for comparison to embodiments of the Applicants' grinder pump.
Figure 9B:
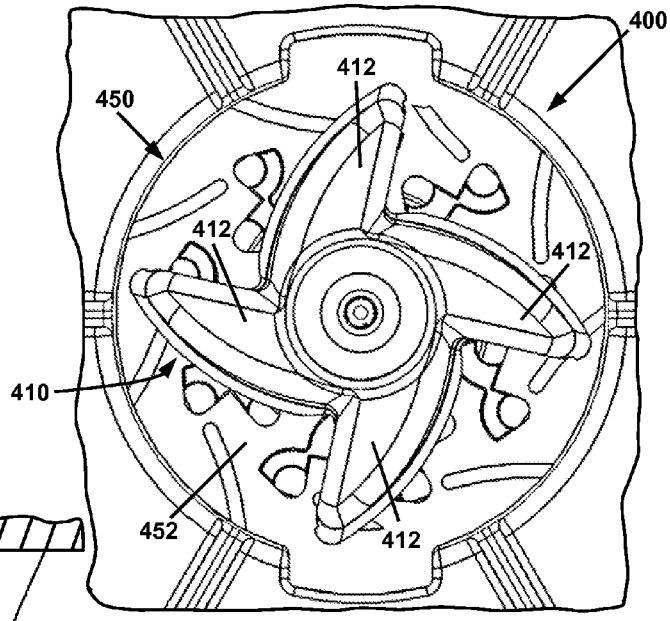
Figure 9C:
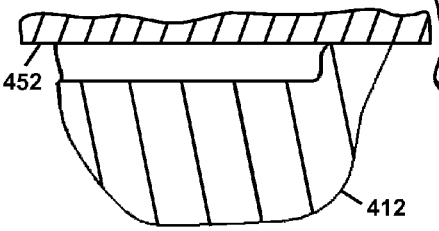
Figure 9D:
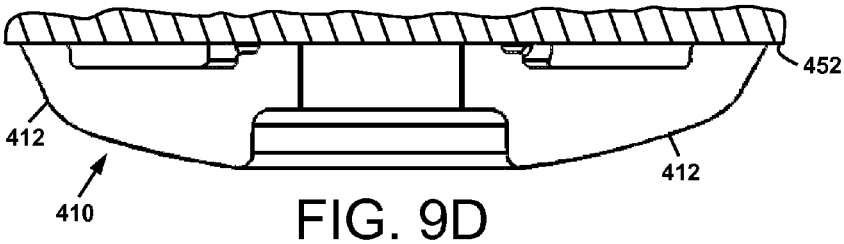

FIGS. 9A-9D depict a prior art cutting assembly 400 that is comprised of a rotary cutter 410 which coacts with a cutter plate 450 to cut solids in the liquid to be pumped. This cutting assembly is disclosed in commonly owned U.S. Pat. No. 7,159,806 of Ritsema, the disclosure of which is incorporated herein by reference. It can be seen that the cutter 410 is comprised of a plurality of blades 412 that cover a large portion of the cutting surface 452 of the cutter plate 450. This large amount of coverage of the cutter plate 450 by the blades 412 increases the operating friction of the cutter assembly. Additionally, each of the blades 412 of the cutter 410 has a blunt profile as can be seen in the views of FIGS. 9C and 9D. This increases the amount of viscous drag from the liquid being pumped. Hence the increased drag and increased friction require more energy to operate this grinder pump.

Figure 10A:
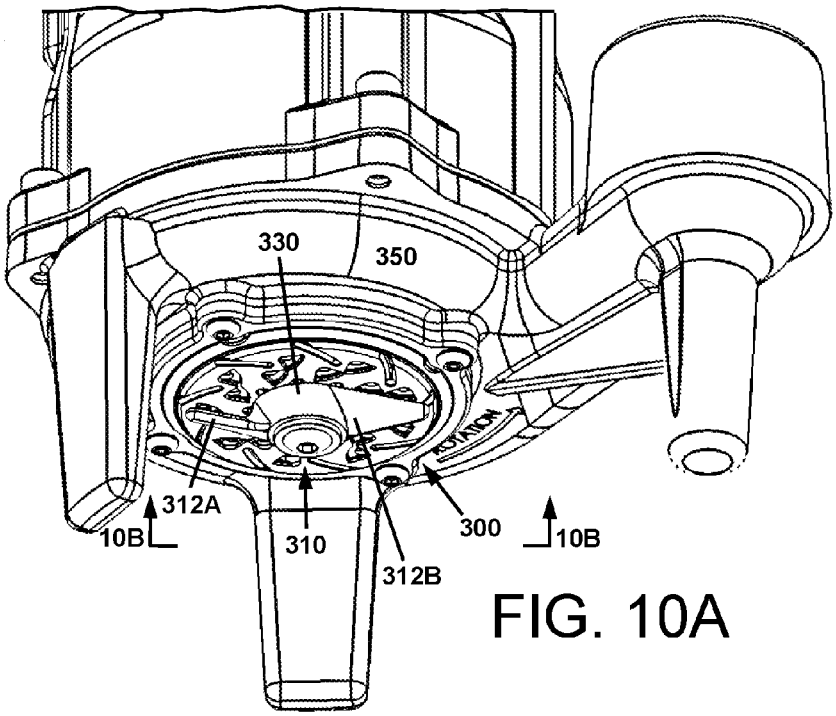
FIG. 10A is a lower perspective view of a cutter and cutter plate of the Applicants' grinder pump.
Figure 10B:
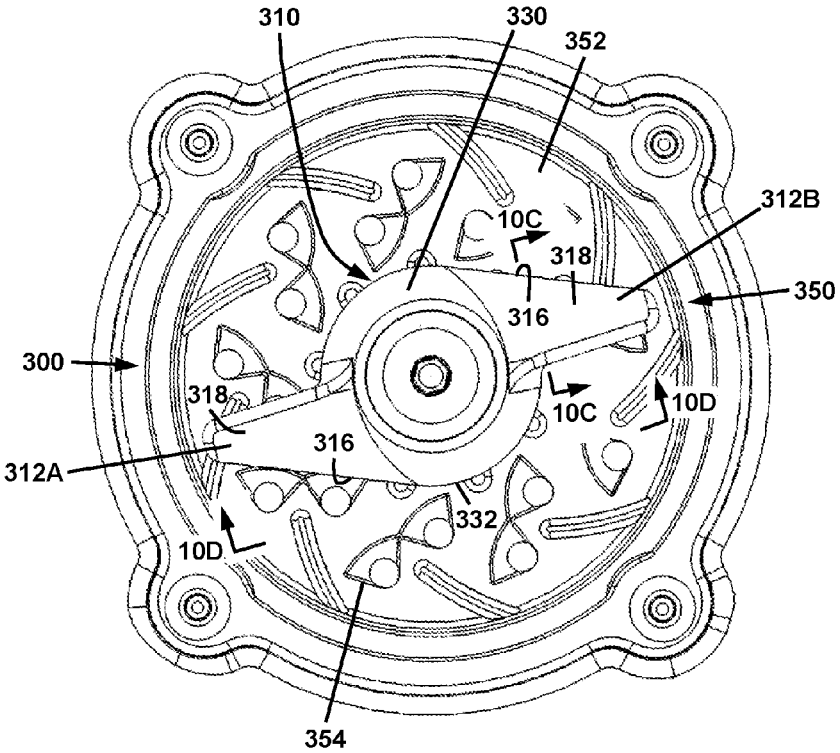
FIG. 10B is a bottom view of the cutter and cutter plate of the pump of FIG. 10A, taken along the line 10B-10B of FIG. 10A.
Figure 10C:
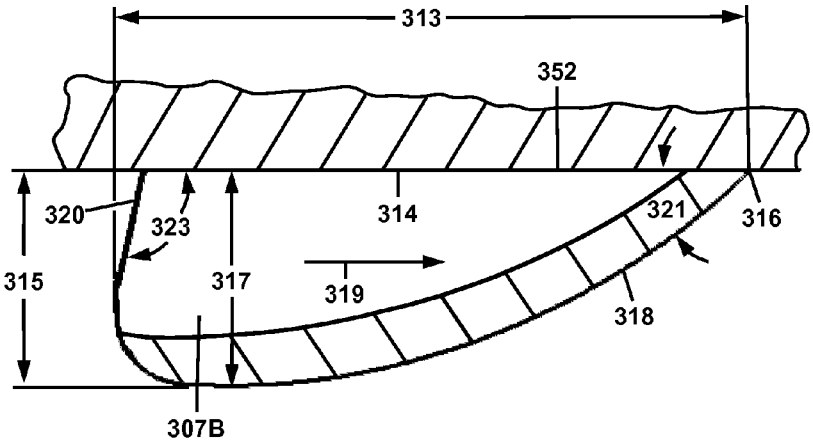
FIG. 10C is a cross-sectional view of a blade of the cutter of the pump of FIG. 10A, taken along the line 10C-10C of FIG. 10B.
Figure 10D:
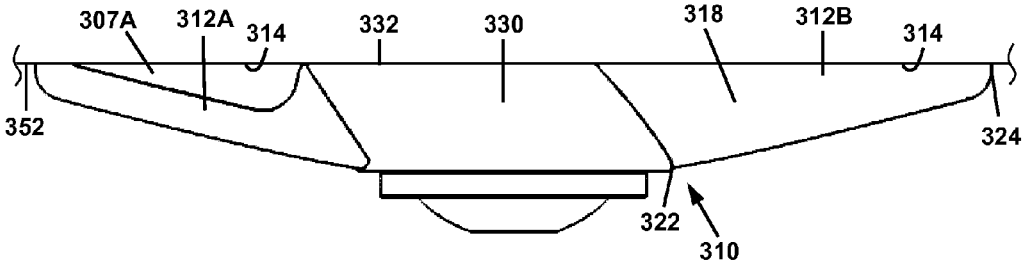
FIG. 10D is a side elevation view of the cutter of the pump of FIG. 10A, taken along the line 10D-10D of FIG. 10B.
Figure 10E:
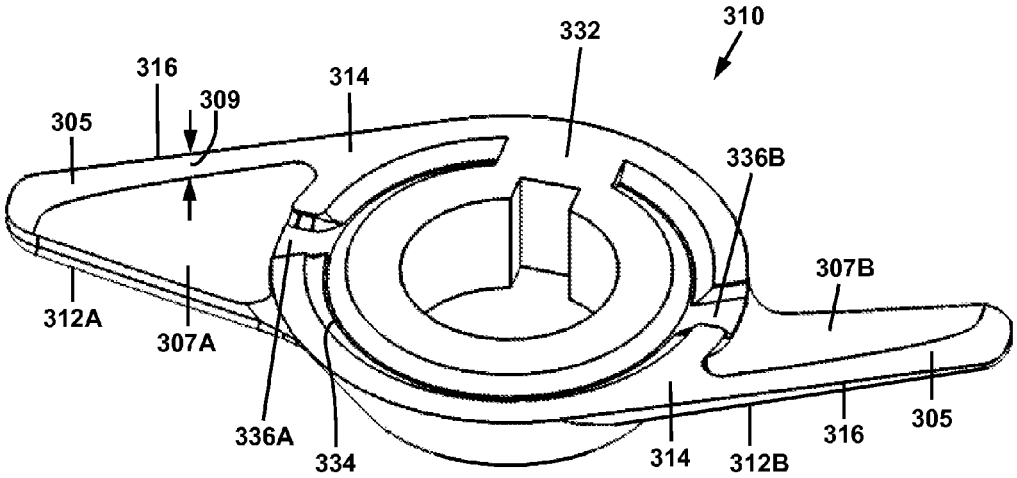
FIG. 10E is a perspective view of the underside of the cutter of the pump of FIG. 10A.

Referring now to FIGS. 2 and 10A-10E, the Applicants' cutting assembly 300 is comprised of a rotatable drive shaft 32 and a rotary cutter 310 joined to the drive shaft 32. The rotary cutter 310 is comprised of a frustoconical hub 330 having a circular planar hub base 332, and a first cutting blade 312A and a second cutting blade 312B. Each of the cutting blades 312A and 312B is comprised of a planar blade base 314 defining a cutting plane and terminating at a cutting edge 316 that extends tangentially outwardly from the circular planar hub base 332. Referring in particular to FIGS. 10C-10E, the surface 305 of the planar blade base 314 may be minimized by providing hollowed-out cavities 307A and 307B on the cutting blades 312A and 312B. The Applicants have found that by reducing the surface area of the planar blade base 314, jamming of the rotary cutter against solid debris is reduced, resulting in more effective cutting. In certain embodiments, the width 309 of the planar blade base proximate to the cutting edges 316 may be about 0.1 inches wide.

The cutting assembly 300 of the pump 10 is further comprised of a cutter plate 350 comprising an outer planar cutter surface 352 that is parallel and proximate to the cutting plane defined by the planar blade bases 314 of the cutting blades 312A and 312B. Rotary motion of the rotary cutter 310 creates a shearing region between the cutting edges 316 of the cutter 310 and the cutter surface 352. To enhance cutting of the solids, the cutter surface 352 may be provided with a plurality of apertures such as V-slice apertures 354 disclosed in the aforementioned U.S. Pat. No. 7,159,806 of Ritsema.

In order to minimize the friction of the cutter 310 with the cutter surface 352 and to avoid jamming of solids between the cutter 310 and the cutter surface 352, the Applicants have found that it is desirable to minimize the "footprint" or contact patch of the blades on the cutter surface 352. This may be accomplished by providing a larger plurality of small blades (e.g., at least three small blades) than shown in FIGS. 3, 10A, and 10B, provided that such small blades have sufficient structural strength to withstand the forces required to cut the solids present. Alternatively, two blades 312A and 312B may be provided as shown in FIGS. 3, 10A, and 10B. In either case, it is desirable that the cutter blades have a low, streamlined profile as shown in FIGS. 10A-10E. This is in marked contrast to the relatively tall and blunt blades 412 of the prior art cutter assembly 400 of FIGS. 9A-9D.

In certain embodiments of the Applicants' low profile streamlined blades, at any radial distance along each cutting blade 312A and 312B, the ratio of the width 313 of the cutting blade 312A/312B to the thickness 315 of the cutting blade 312A/312B at that radial distance is at least about two, and preferably at least about three. Additionally, at any radial distance along each cutting blade, the maximum thickness 317 of the cutting blade may be located at least 70 percent across the cutting blade in the direction opposite the direction of rotation 319. The first and second cutting blades 312A and 312B may be further comprised of a first angled outer surface 318 terminating at the cutting edge 316. In such a configuration, the first angled outer surface 318 is on the leading side of the blade 312A/312B with respect to the direction of cutter rotation 319, and forms an acute angle 321 with the blade base 314. In certain embodiments, the angle 321 may be less than 45 degrees. In one exemplary embodiment fabricated by the Applicants, the angle 321 was 33 degrees.

The first and second cutting blades 312A and 312B may be further comprised of a second angled outer surface 320 terminating at the blade base 314. In such a configuration, the second angled outer surface 320 is on the trailing side of the blade 312A/312B with respect to the direction of cutter rotation 319, and may form an approximately perpendicular or obtuse angle 323 with the blade base.

In certain embodiments, the first and second cutting blades 312A and 312B may have a radially varying thickness from a maximum thickness at their innermost portions 322 proximate to the frustoconical hub 330 to one half of the maximum thickness at 60 percent of the distance to the outermost portion 324 of the first and second blades 312A and 312B. In one exemplary embodiment fabricated by the Applicants, the thickness of the blades 312A and 312B tapered to one half of their maximum thickness at 70 percent of the distance to their outermost portions 324. The radial variation in thickness of the first and second cutting blades 312A and 312B may be linear between their innermost portions 322 and about 90 percent of the distance to their outermost portions 324. The maximum thickness of the first and second blades 312A and 312B may be equal to the thickness of the frustoconical hub 330.

In certain embodiments, the circular planar hub base 332 of the frustoconical hub 330 may be provided with an annular channel 334, and radial connecting channels 336A and 336B, which extend from annular channel 334 to hollowed-out cavities 307A and 307B on the cutting blades 312A and 312B, respectively. The Applicants have discovered that providing such channels prevents and/or facilitates the discharge of any solid accumulation between the frustoconical hub 330 and the outer planar cutter surface 352, thereby reducing operating friction and improving cutter efficiency.

The Applicants note that the above exemplary angles and ratios of the blades 312A and 312B of the rotary cutter 310 are in marked contrast to the blades 412 of the prior art cutter assembly 400 of FIGS. 9A-9D. These blades 412 have a ratio of width to thickness of about 1.8, a maximum thickness that occurs at about the center of the blades 412, an angle at the cutting edge of about 70 degrees, and taper radially to a half thickness at about 84 percent of their lengths. As noted previously, the cutter 410 has a plurality of blades 412 that have a large footprint on the cutter plate 450, and are blunt rather than streamlined. Thus the Applicants' cutter 310 has less operating friction with its corresponding cutter plate 350, and less drag in the liquid being pumped. Accordingly, the Applicants' cutter assembly 300 and pump 10 uses less energy to accomplish the same cutting and pumping results.

It is, therefore, apparent that there has been provided, in accordance with the present invention, liquid pumps having improved reliability, ease of assembly, increased precision of assembly, and/or lower manufacturing cost. Having thus described the basic concept of the invention, it will be rather apparent to those skilled in the art that the foregoing detailed disclosure is intended to be presented by way of example only, and is not limiting. Various alterations, improvements, and modifications will occur to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims.

I claim:

1. A pump comprising:

a) a motor housing comprising a lower planar surface and containing a motor comprised of a rotatable shaft; and b) an impeller joined to a distal end region of the rotatable shaft;

c) a unitary pump volute housing joined to the motor housing, the unitary pump volute housing formed as a single piece and comprised of:

an upper wall, a side wall, and a lower wall extending radially inwardly from the side wall and having a through opening sized to receive the impeller therethrough, wherein the upper, side, and lower walls define a volute chamber;

a first outer annular structure extending upwardly from the upper wall of the volute chamber and comprising a lower portion including a lower side wall and an upper portion including an upper cylindrical cavity comprised of a first annular side wall and a bottom wall extending radially inwardly from the first annular side wall;

an inner annular structure extending downwardly from the bottom wall of the upper cylindrical cavity, terminating at a planar bottom surface, and comprising an inner wall defining a cylindrical passageway extending from the bottom wall of the upper cylindrical cavity to the volute chamber; and a planar flange contiguous with the lower planar surface of the motor housing, and surrounding the first outer annular structure, and having an inner perimeter;

wherein the first annular side wall, the cylindrical passageway, the rotatable shaft, the through opening, and the planar flange have collinear central axes defining a common central axis; and wherein the bottom wall of the cylindrical cavity, the planar bottom surface of the inner annular structure, and the planar flange define planes parallel to each other and perpendicular to the common central axis.

2. The pump of claim 1, further comprising a second outer annular structure surrounding the first outer annular structure and extending upwardly from the upper wall of the volute chamber.

3. The pump of claim 2, wherein the second outer annular structure is comprised of an outer cylindrical wall contiguous with the inner perimeter of the planar flange and having a central axis collinear with the common central axis.

4. The pump of claim 1, further comprising a cover removably disposed in the through opening and having a cover opening surrounding the common central axis.

5. The pump of claim 4, wherein the cover opening is a cylindrical opening having a central axis collinear with the common central axis.

6. The pump of claim 1, further comprising an annular recess surrounding the inner wall of the inner annular structure.

7. The pump of claim 1, further comprising a cutting assembly comprised of a cutter plate disposed in the through opening of the lower wall of the pump volute housing and joined to the volute housing, the cutter plate comprising a fixed outer planar cutting surface; and a rotary cutter joined to the motor shaft and comprising a cutting blade rotatable relative to the fixed outer planar cutting surface and comprised of a planar blade base defining a cutting plane parallel to the fixed outer planar cutting surface of the cutter plate, the planar blade base and the fixed outer planar cutting surface forming a shearing region therebetween.

8. The pump of claim 1, wherein the impeller is joinable to the distal end region of the rotatable shaft by passing the impeller through the through opening of the volute housing.

9. The pump of claim 1, wherein the rotatable shaft includes an upper region and a shaft seal region between the upper region and distal end region, and wherein the pump further comprises a shaft seal surrounding and sealingly engaged with the shaft seal region of the shaft, the shaft seal comprising an upper seal portion disposed in the passageway of the inner annular structure, and a lower seal portion disposed in an annular cavity formed between the rotatable shaft and an upward annular structure extending above a top surface of a flange of the impeller.

10. The pump of claim 9, wherein the length of the upper seal portion of the rotary shaft disposed in the passageway of the inner annular structure and the length of the lower seal portion of the rotary shaft disposed in the annular cavity include the majority of the shaft seal region of the rotatable shaft.

11. A pump comprising:

a) a pump volute housing enclosing a volute chamber, the pump volute housing comprised of:
   an upper wall;
   an outer annular structure extending upwardly from the upper wall; and
   an inner annular structure extending downwardly from an upper region of the outer annular structure, terminating at a planar bottom surface, and comprising an inner wall defining a passageway extending downwardly therethrough;

b) rotatable shaft comprising an upper region, a distal end region, and a shaft seal region between the upper region and distal end region;

c) a rotary impeller joined to the distal end region of the rotatable shaft and comprising a flange comprised of a top surface, and an upward annular structure extending above the top surface of the flange;

d) a shaft seal surrounding and sealingly engaged with the shaft seal region of the rotatable shaft and comprising an upper seal portion disposed in the passageway of the inner annular structure, and a lower seal portion disposed in an annular cavity formed between the rotatable shaft and the upward annular structure of the rotary impeller and in fluid communication with the volute chamber.

12. The pump of claim 11, wherein the upper portion of the seal is in communication with a housing cavity of a motor housing joined to the pump volute housing.

13. The pump of claim 11, wherein an upper portion of the shaft seal region of the rotatable shaft is surrounded by the upper seal portion of the shaft seal and a lower portion of the shaft seal region of the rotatable shaft is surrounded by the lower seal portion of the shaft seal.

* * * * *